US009975662B1

(12) United States Patent
Forman

(10) Patent No.: US 9,975,662 B1
(45) Date of Patent: May 22, 2018

(54) MULTI-CHAMBERED DRINK CONTAINER

(71) Applicant: Julian Curtis Forman, Gainesville, GA (US)

(72) Inventor: Julian Curtis Forman, Gainesville, GA (US)

( * ) Notice: Subject to any disclaimer, the term of this patent is extended or adjusted under 35 U.S.C. 154(b) by 0 days. days.

(21) Appl. No.: 15/356,485

(22) Filed: Nov. 18, 2016

(51) Int. Cl.

| | |
|---|---|
| ***B65D 1/24*** | (2006.01) |
| ***B65D 25/08*** | (2006.01) |
| ***A47G 21/18*** | (2006.01) |
| ***B65D 81/32*** | (2006.01) |
| ***A47G 19/22*** | (2006.01) |
| ***B65D 17/00*** | (2006.01) |

(52) U.S. Cl.
CPC ..... *B65D 25/08* (2013.01); *A47G 19/2205* (2013.01); *A47G 21/18* (2013.01); *B65D 17/16* (2013.01); *B65D 17/28* (2018.01); *B65D 81/32* (2013.01)

(58) Field of Classification Search
CPC ..... B65D 25/00–25/08; B65D 17/16; B65D 81/32; A47G 19/22–19/2205; A47G 21/18
USPC ..... 220/500–557, 703–709, 592.16, 592.17
See application file for complete search history.

(56) References Cited

U.S. PATENT DOCUMENTS 5,257,487 A * 11/1993 Bantz ..... H02G 3/283 174/486
5,351,819 A * 10/1994 Varon ..... B65D 5/48024 206/232
5,626,284 A * 5/1997 Franzen ..... B65D 5/48038 229/120.36
5,758,818 A * 6/1998 Ewing, Jr. ..... B65D 5/5495 229/120.011
5,941,377 A * 8/1999 Hart ..... B65D 71/0077 206/175
7,066,379 B2 * 6/2006 McLeod ..... B65D 5/321 229/120.24
7,954,637 B2 * 6/2011 Hausmann ..... B65D 5/48038 206/524.4
8,153,910 B1 * 4/2012 Penczak ..... H02G 3/185 174/486
2001/0032873 A1 * 10/2001 Grueneberg ..... B65D 5/32 229/117.06
2004/0108370 A1 * 6/2004 Lee ..... B65D 5/48002 229/120.13

* cited by examiner

*Primary Examiner* — Kareen Thomas

(57) ABSTRACT

A drink container includes an outer body with an inner separation membrane separating two chambers, the separation membrane having a through-passage connecting the two chambers, straw holes through the top of outer body into each of the two chambers, enabling a user to introduce a straw into one or both of the chambers to consume liquid content of the chambers, a flexible closure membrane sealed to the separation membrane by a separable adhesive, over the through-passage, and a pull strip overlying the closure membrane, attached to a lowermost end of the closure membrane, and passing through a slit on top of the outer body, ending in a pull tab outside the top of the outer body. Grasping the pull tab and pulling the pull strip upward through the slit peels the closure membrane away from the separation membrane, opening the through passage, enabling contents in the two chambers to mix.

2 Claims, 3 Drawing Sheets

MULTI-CHAMBERED DRINK CONTAINER

BACKGROUND OF THE INVENTION

1. Field of the Invention

The present invention pertains to the field of consumer drink containers.

2. Discussion of the State of the Art"

Drink pouches and boxes (herein referred to as "containers") are a very popular beverage product for consumers, most notably children. It is typically smaller than a soda can or bottle, and is made of laminated foil, cardboard, or similar pliable materials, to make it safe and easily held by small hands.

Consumers typically purchase drink containers based on a preferred flavor. These containers are not sold individually, but rather in a bulk package containing multiple drink containers. The problem is that each container within the bulk package is the same flavor, and there is no flexibility to purchase a package with multiple flavors, nor is there an ability to combine multiple flavors to enjoy a blended flavor.

Therefore, what is clearly needed is a drink container that solves the limitations mentioned above.

BRIEF SUMMARY OF THE INVENTION

In one embodiment of the invention a drink container is provided comprising an outer body separated by an inner, substantially vertical, separation membrane into two separate chambers, the separation membrane having a through-passage connecting the two chambers, a self-sealing straw hole through a top of the outer body into each of the two separate chambers, enabling a user to introduce a straw into one or both of the chambers to consume liquid content of the chambers, a flexible closure membrane sealed to the separation membrane by a separable adhesive, above and over the through-passage, a pull strip overlying the flexible closure membrane, attached to a lowermost end of the flexible closure membrane, and passing through a slit through a top of the outer body, ending in a pull tab outside the top of the outer body, wherein grasping the pull tab and pulling the pull strip upward through the slit peels the flexible closure membrane away from the separation membrane, opening the through passage, enabling contents in the two separate chambers to mix.

Also in one embodiment the drink container includes a second separation membrane having a second through-passage with a second flexible closure membrane over the second through-passage, and a pull strip connected to the second flexible closure membrane passing through a second slit in the top of the outer body, ending in a second pull tab.

DETAILED DESCRIPTION OF THE INVENTION

The inventor provides a unique drink container with multiple chambers, enabling the consumer to enjoy different drink flavors independently, or mix the contents of each chamber to enjoy a new, blended flavor. The present invention is described in enabling detail in the following examples, which may represent more than one embodiment of the present invention.

Figure 1:
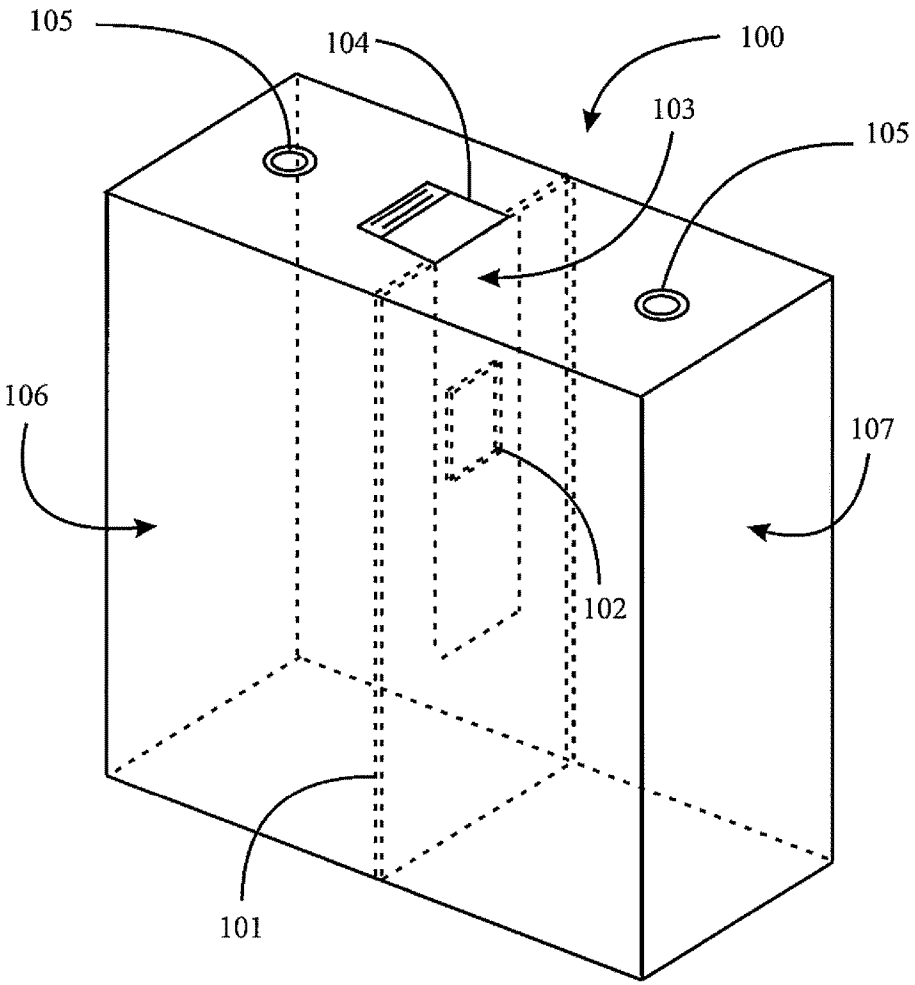
FIG. 1 is a perspective view of a drink container according to an embodiment of the present invention.

FIG. 1 is a perspective view of a drink container 100 according to an embodiment of the present invention. Drink container 100 is, in this example, a dual-chambered embodiment of the present invention. The two chambers in this example are divided by a separation membrane 101, which serves to isolate a drink of unique flavor and/or color in a first chamber 106 from the unique flavor and/or color in a second chamber 107. The consumer may access the drink flavor in either chamber with a straw by way of a straw hole 105.

In this example, a pull strip 104 is located at the top of drink container 100. The pull strip 104 is attached to a strip assembly 103 inside the drink container, which covers an opening 102 between the first chamber 106 and the second chamber 107.

Figure 2A:
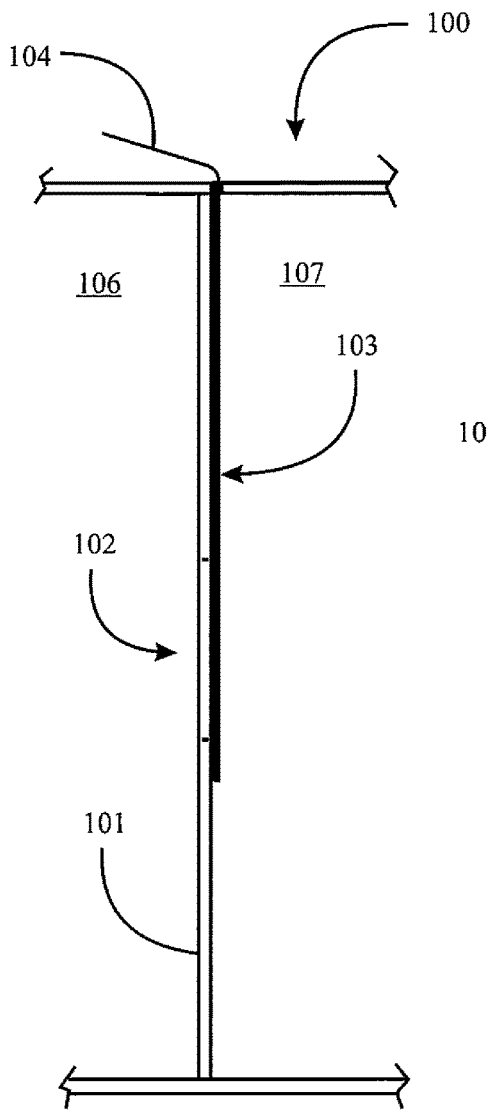
FIG. 2*a* is an elevated frontal view of the drink container of FIG. 1.

FIG. 2*a* is an elevated frontal view of the separation membrane 101 of the drink container of FIG. 1. This embodiment includes components that were previously introduced in FIG. 1. Those components previously introduced that have not changed in this examples retain their original element numbers and are not reintroduced.

The pull strip 104 is connected inside the drink container 100 to a strip assembly 103, which covers the opening 102 between the first chamber 106 and the second chamber 107. In another embodiment, there may be more than one opening 102.

Figure 2B:
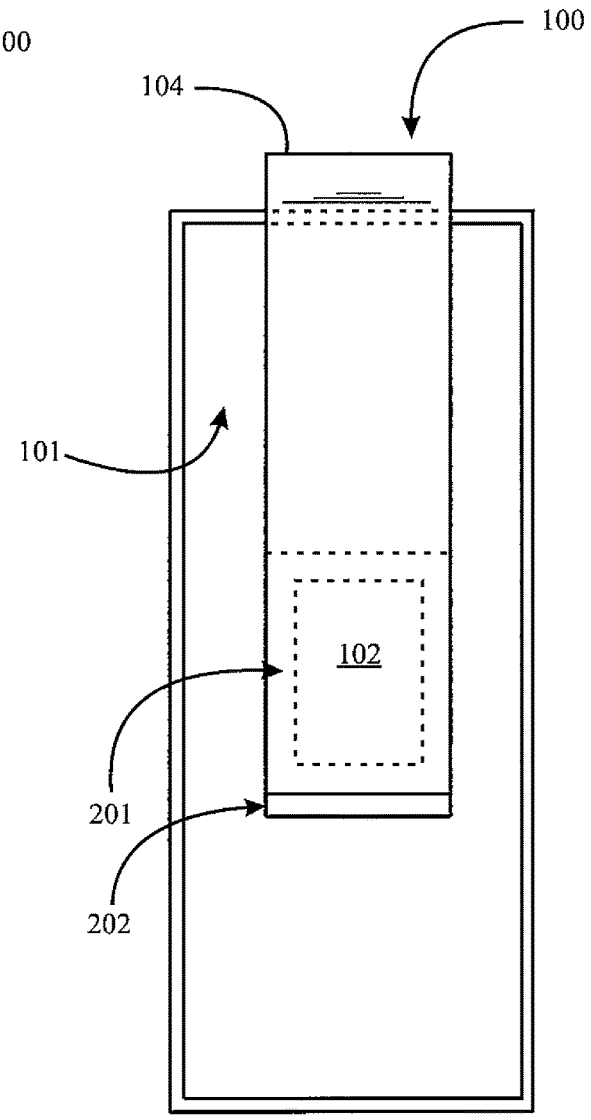
FIG. 2*b* is an elevated side view of the drink container of FIG. 1.

FIG. 2*b* is an elevated side view of the separation membrane 101 of the drink container of FIG. 1. This embodiment includes components that were previously introduced in FIG. 1. Those components previously introduced that have not changed in this example retain their original element numbers and are not reintroduced.

In this example, the pull strip 104 connects inside the drink container 100 to a closure membrane 203. The pull strip 104 connects to the closure membrane 203 in this example with a permanent adhesive 202, but may connect in other ways as well. Closure membrane 203 is not shown in FIG. 2*b*, but may be seen in FIG. 2*c*, described below.

In this embodiment, [[a]] closure membrane 203 is attached to the separation membrane 101 by a light adhesive 201. The light adhesive 201 provides a seal between the chambers, until such time as a user pulls the strip 104 to release the light adhesive 201 and peel the closure membrane 203 away from the separation membrane 101. In alternative embodiments, there may be a closure membrane 203 on both sides of the separation membrane 101, and potentially a pull strip 104 to peel both closure membranes 203.

Figure 2C:
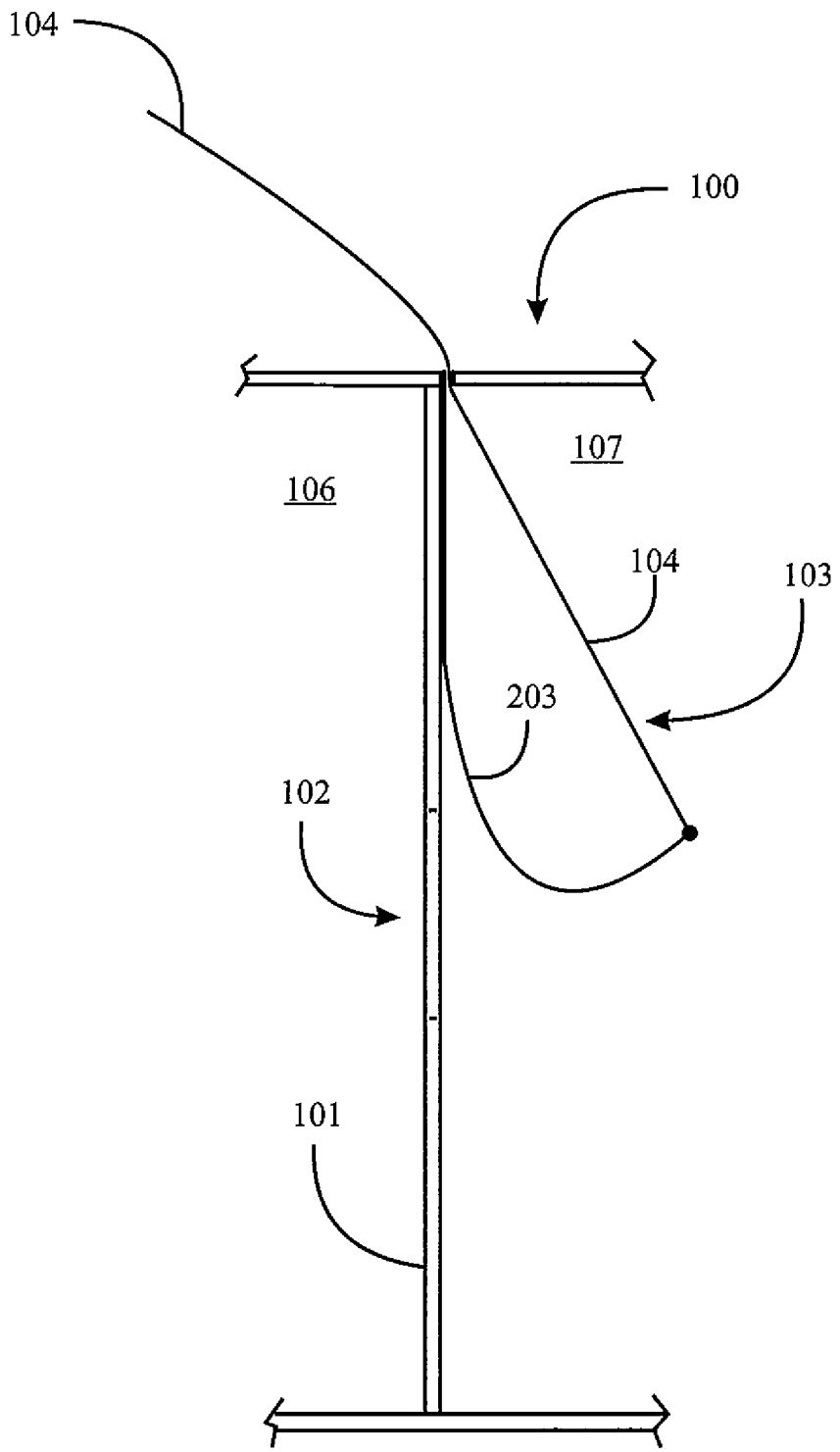
FIG. 2*c* is an elevated side view of the drink container of FIG. 1 depicting motion.

FIG. 2*c* is an elevated side view of the separation membrane 101 of the drink container of FIG. 1, depicting motion. This embodiment includes components that were previously introduced in FIG. 1. Those components previously introduced that have not changed in this examples retain their original element numbers and are not reintroduced.

At the time a user wishes to combine the different flavors and/or colors, from the first chamber 106 and the second chamber 107 in this embodiment, they may do so by pulling [[a]] strip 104, located at the top of drink container 100. The strip 104 is connected inside the drink container 100 to a strip assembly 103. In this example, the strip assembly 103 is connected to the closure membrane 203.

In one embodiment, the user pulls [[a]] strip 104, which pulls the strip assembly 103, which peels away the closure membrane 203 from the separation membrane 101, revealing an opening 102 in the separation membrane 101. In this example, the opening 102 between the first chamber 106 and the second chamber 107 allows the drink flavors and colors to mix, thus producing a new and different flavor in a new and different color.

It will be apparent to one with skill in the art that the multi-chambered drink container of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

The invention claimed is:

1. A drink container comprising:

an outer body separated by an inner, substantially vertical, separation membrane into two separate chambers, the separation membrane having a through-passage connecting the two chambers;

a self-sealing straw hole through a top of the outer body into each of the two separate chambers, enabling a user to introduce a straw into one or both of the chambers to consume liquid content of one or both of the chambers;

a flexible closure membrane sealed to the separation membrane by a separable adhesive, above and over the through-passage;

a pull strip overlying the flexible closure membrane, attached to a lowermost end of the flexible closure membrane, and passing through a slit through a top of the outer body, ending in a pull tab outside the top of the outer body;

wherein grasping the pull tab and pulling the pull strip upward through the slit peels the flexible closure membrane away from the separation membrane, opening the through passage, enabling contents in the two separate chambers to mix.

2. The drink container of claim 1 comprising a second separation membrane having a second through-passage with a second flexible closure membrane over the second through-passage, and a pull strip connected to the second flexible closure membrane passing through a second slit in the top of the outer body, ending in a second pull tab.

* * * * *